US006521314B2

(12) United States Patent
Tychsen

(10) Patent No.: US 6,521,314 B2
(45) Date of Patent: Feb. 18, 2003

(54) PANEL, PARTICULARLY A FLOOR PANEL

(75) Inventor: Detlef Tychsen, Lohne (DE)

(73) Assignee: Kronotec AG, Lucerne (CH)

( * ) Notice: Subject to any disclaimer, the term of this patent is extended or adjusted under 35 U.S.C. 154(b) by 0 days.

(21) Appl. No.: 09/756,289

(22) Filed: Jan. 9, 2001

(65) Prior Publication Data

US 2001/0021432 A1 Sep. 13, 2001

(30) Foreign Application Priority Data

Feb. 22, 2000 (DE) ..... 100 08 108

(51) Int. Cl.[7] ..... B32B 3/00
(52) U.S. Cl. ..... 428/60; 428/57; 428/192
(58) Field of Search ..... 428/60, 58, 192; 52/309.12, 592.1, 392, 589.1, 592.2, 591.4; 404/41, 46

(56) References Cited

FOREIGN PATENT DOCUMENTS

| | | |
|---|---|---|
| DE | 76438 | 7/1972 |
| JP | 3169967 | 7/1991 |
| WO | WO94/01628 | 1/1994 |
| WO | WO97/47834 | 12/1997 |

*Primary Examiner*—Harold Pyon
*Assistant Examiner*—Jane Rhee
(74) *Attorney, Agent, or Firm*—McGuireWoods LLP

(57) ABSTRACT

A panel, particularly a floor panel, which exhibits a spring on at least one side and a groove on the opposite side, which features are designed in complementary fashion such that several panels can be connected by inserting one panel into the other, while the spring/groove connection is provided with interlocking portions which prevent the two panels from sliding against the connecting direction, is distinguished by the fact that the spring exhibits a slit that runs parallel to the upper side of the panel and the groove exhibits a wedge-shaped projection at its base.

20 Claims, 1 Drawing Sheet

PANEL, PARTICULARLY A FLOOR PANEL

BACKGROUND OF THE INVENTION

1. Field of the Invention

The invention relates to a panel, particularly a floor panel, which exhibits a spring on at least one side and a groove on the opposite side, which features are designed in such a way that several panels can be combined by insertion into each other, while the spring/groove connection is provided with interlocking means that prevents displacement of two panels against the direction of the connection.

2. Background Description

Panels of this kind are disclosed in, e.g., WO97/47834 and JP 3-169967. These panels can be combined without the use of, e.g., glue on the substructure or without the need for additional connecting members. The connecting edges of two floor panels can be inserted one into the other by insertion along a straight line, parallel to the substructure; here the form-fit of the interlocking means prevents the panels from sliding counter to the direction of connection. The corresponding design of the spring/groove is called the "click profile". So that the form-fit between the interlocking means can take effect, the spring of the first panel bends the lower lip of the groove of the second panel in the direction of the lower side when the two panels are brought together for insertion.

Panels of this kind are generally produced from wood materials, particularly HDF or MDF. Consequently the elasticity of the lower lip cannot be precisely adjusted. Particularly when two panels are interlocked improperly it is impossible to exclude the possibility that the lower lip will be bent too far and will break, a circumstance that may not necessarily be noticed when the panels are being laid, but that will result in a poor connection or none at all.

Known from WO 94/01628 are connecting elements for floor panels that are attached to the panels on the lower side and that make possible a snap connection. At one connecting element there is a groove and at the other a spring. The spring of the connecting element is slotted, so as to form two elastic lips. Each lip is provided with a wedge-shaped heel. The groove of the other connecting element exhibits corresponding undercuts. When the two connecting elements are interlocked, the two lips of the spring are pressed together and then spring apart when the projections engage with the undercuts.

DE 72 07 395 discloses a connecting element by means of which two panels with swallow-tailed grooves can be connected. In keeping with the swallow-tailed shape of the grooves, the connecting element has the shape of a wedge and has a center slit on either side. By means of the slit, the connecting element can be pressed together so that the shape complementary to the swallowtail of the groove is canceled and the spring component can be laterally inserted into the groove. The legs then spring back and fill out the groove.

SUMMARY OF THE INVENTION

Proceeding from this description of the problem, the goal is to improve the initially described panel. The problem is solved in a panel of the generic type in that the spring exhibits a slit that runs parallel to the upper side and the groove, at its bottom, exhibits a wedge-shaped projection which engages with the slit when the panels are brought together.

With this design the spring is given two parts and becomes elastic. The two spring parts are pressed together upon insertion into the groove of another panel. When the interlocking means engage, the two parts spring apart and the form-fitting connection is produced.

The tip of the projection rests at same the level as the slit in the spring and when the two panels are brought together it engages with the slit and forces the two spring parts outward, so that there is a secure lock. At the same time, stability in the spring-groove connection is increased, since the two parts of the spring are supported at their free ends.

The elasticity of the two spring parts increases with the depth of the slit, so that slit will ideally extend over the entire width of the spring.

The interlocking means will ideally be formed by a projection that is provided on the spring and that projects toward the lower side of the panel, and by a recess provided in the groove. As an alternative, the projection can be provided in the groove and the recess in the spring.

It is advantageous if the projection and the recess are so positioned in relationship to each other that two inserted panels are in a stressed state, at least at the point of connection of the upper sides. This will create a tight connection on the upper side, which forms the panel's visible surface, and will prevent the penetration of moisture, without the need for a further seal.

The spring and the groove can be positioned on both the longitudinal and the lateral sides of the panel, so that the same connecting technology can be applied on all sides, particularly when a floor is laid, thereby facilitating the process of laying the floor.

BRIEF DESCRIPTION OF THE DRAWINGS

The foregoing and other objects, aspects and advantages of an exemplary embodiment of the invention will next be described in greater detail, with the aid of a drawing. Shown are.

DETAILED DESCRIPTION OF A PREFERRED EMBODIMENT OF THE INVENTION

Figure 1:
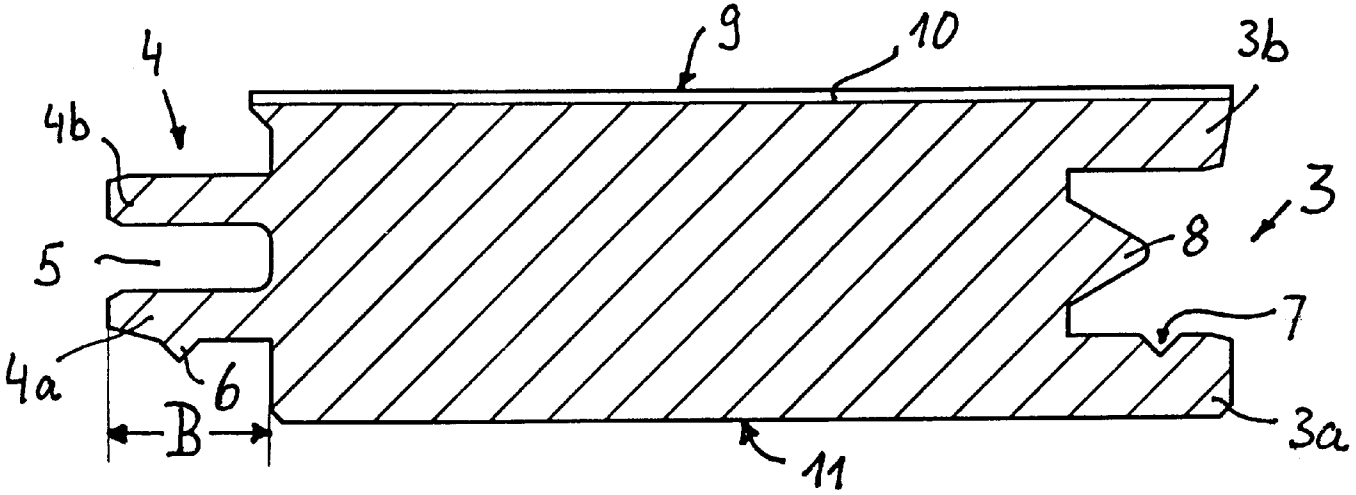
FIG. 1 shows a section through a panel.

The panel 1, 2 consists of a wood material, for example, MDF, and exhibits an upper side 9, applied to which is a decorative layer 10, and a lower side 11. On its opposite sides, the panel 1,2 is provided with a spring 4 and a groove 3. Over its entire length (not visible here) the spring 4 is provided with a central slit 5 whose depth extends over the entire width B of the spring 4. The slit divides the spring 4 into a lower part 4*a* and an upper part 4*b*—parts that can be moved elastically toward each other. At its base, the groove 3 is provided with a projection 8 that is wedge-shaped and points outward. The point of the wedge lies roughly at the center of the groove and corresponds to the height of the slit 5. The depth of the groove 3 is greater than the width B of the spring.

Figure 2:
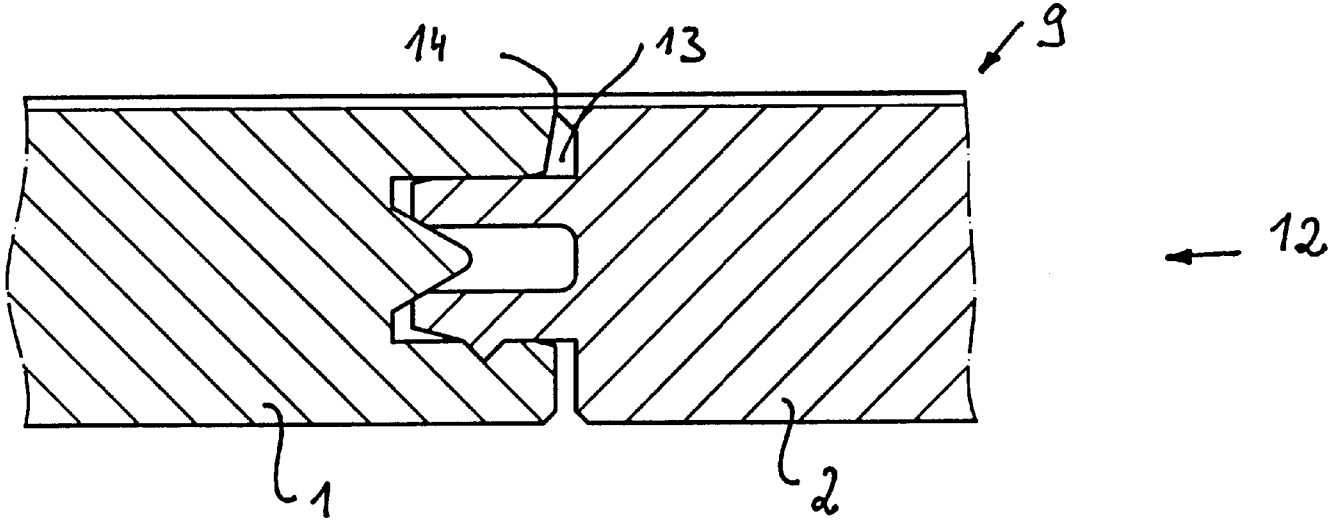
FIG. 2 demonstrates a section at the connecting point of two inserted panels.

The lower lip 3*a* of the groove 3 is provided with an indentation 7. The lower part 4*a* of the spring 4 exhibits a projection 6 that corresponds in shape to the indentation. As FIG. 2 shows, when two panels 1, 2 are combined the projection 8 of the groove 3 engages with the slit 5 of the spring 4 and pushes the two spring parts 4*a*, 4*b* away from each other, while the projection 6 is forced into the indentation 7. The panels 1, 2 thereby lock together, and displacement against the connecting direction 12 is effectively eliminated.

The positioning of the projection 6 and the indentation 7 relative to each other is selected in such a way that the panels 1, 2 are stressed at least at the connecting point 14 on the upper side 9—such that a tight connection is produced. In order to avoid excess stress—which would result in an increased expenditure of force when the panels 1, 2 are laid (inserted)—the upper lip 3*b* of the groove 3 is slightly beveled on its face and the panel 1, 2 on the opposite side is recessed, so that an open space 13 is formed between the connected panels 1, 2.

Having thus described my invention, what I claim as new and desire to secure by Letters Patent is as follows:

1. A panel, particularly a floor panel, comprising a spring on at least one side and a groove on the opposite side, wherein the spring/groove connection is provided with an interlocking mechanism which prevent two panels from sliding against a connecting direction, wherein the spring includes a slit that runs parallel to the upper side of the panel and the groove includes at its base a wedge-shaped projection that engages with the slit when the panels are inserted one into another panel.

2. A panel according to claim 1, wherein the slit extends over the entire width of the spring.

3. A panel according to claim 1, wherein the interlocking means are formed by a projection that is provided on the spring and extends in the direction of the lower side and by an indentation provided in the groove.

4. A panel according to claim 1, wherein the interlocking means are formed by an indentation provided on the spring and extending in the direction of the upper side and by a projection provided in the groove.

5. A panel according to claim 3, wherein the projection and the indentation are positioned such that two connected panels are in state of tension at the point of connection of the upper sides.

6. A panel according to claim 3, wherein the projection and the indentation extend over the entire length of the spring or the groove.

7. A panel according to claim 1, wherein the spring and the groove are positioned on the longitudinal and lateral sides of the panel.

8. A panel comprising:

a groove having an upper lip and a lower lip, an open end and an opposing, base portion, the groove being positioned on a first edge of the panel;

a spring having an upper part and a lower part which can be moved elastically toward each other, and a centrally located slit extending between the upper part and the lower part, the spring being positioned on another edge of the panel; and a wedge-shaped projection positioned at the opposing, base portion of the groove, the wedge-shaped projection extending towards the open end of the groove.

9. The panel of claim 8, wherein one of the spring and the groove is provided with an indentation and the other of the spring and the groove is provided with a projection.

10. The panel of claim 9, wherein the lower part of the spring includes the indentation facing downwards and the lower lip of the groove includes the projection facing upwards towards the indentation.

11. The panel of claim 9, wherein the lower lip of the groove includes the indentation and the projection is on the lower part of the spring.

12. The panel of claim 9, wherein when connecting panels are locked to one another via the indentation and the projection, the groove engages with the slit of the spring and pushes the upper part and the lower part of the spring away from each other, while the projection is forced into the indentation.

13. The panel of claim 8, wherein a point of the wedge lies roughly at a center of the groove and the wedge-shaped projection corresponds to a height of the slit.

14. The panel of claim 8, wherein a depth of the groove is greater than a width of the spring.

15. The panel of claim 9, wherein the projection and the indentation have a same shape.

16. The panel of claim 8, wherein the upper lip includes a beveled portion and a recess is formed above the upper part of the spring so that an open space is formed between connected panels.

17. A panel comprising:

a groove having an upper lip and a lower lip, an open end and an opposing, base portion, the groove being positioned on a first side of the panel;

a spring having an upper part and a lower part which is movable elastically toward each other, and a centrally located slit extending between the upper part and the lower part, wherein one of the spring and the groove is provided with an indentation and the other of the spring and the groove is provided with a projection; and wherein a wedge-shaped projection is positioned at the opposing, base portion of the groove, the wedge-shaped projection extends towards the open end of the groove.

18. The panel of claim 17, wherein a point of the wedge lies roughly at the center of the groove and the wedge-shaped projection corresponds to the height of the slit;

a depth of the groove is greater than a width of the spring;

the upper lip includes a beveled portion and a recess is formed above the upper part of the spring so that an open space if formed between connected panels; and when connecting panels are locked to one another, the groove engages with the slit of the spring and pushes the upper part and the lower part of the spring away from each other, while the projection is forced into the indentation.

19. The panel of claim 17, the lower part of the spring includes the indentation facing downwards and the lower lip of the groove includes the projection facing upwards towards the indentation.

20. A panel, particularly a floor panel, comprising a spring on at least one side and a groove on the opposite side, wherein the spring/groove connection is provided with an interlocking mechanism which prevent two panels from sliding against a connecting direction, wherein the spring includes a slit that runs parallel to the upper side of the panel and the groove includes a projection that engages with the slit when the panel is inserted into another panel.

* * * * *